United States Patent [19]

Susini et al.

[11] Patent Number: 4,887,973

[45] Date of Patent: Dec. 19, 1989

[54] CONFORMING DEVICE FOR A FLEXIBLE FILM PROVIDED WITH PROJECTING MOUTHPIECES

[75] Inventors: Etienne Susini, Villecresnes, France; Pierre Soubrier, Brussels, Belgium

[73] Assignee: Baxter International Inc., Deerfield, Ill.

[21] Appl. No.: 155,925

[22] PCT Filed: May 20, 1987

[86] PCT No.: PCT/FR87/00171

§ 371 Date: Mar. 2, 1988

§ 102(e) Date: Mar. 2, 1988

[87] PCT Pub. No.: WO87/07245

PCT Pub. Date: Dec. 3, 1987

[30] Foreign Application Priority Data

May 21, 1986 [FR] France ..... 86 07207

[51] Int. Cl.[4] ..... B65H 45/09; B29C 53/04; B31B 23/00

[52] U.S. Cl. ..... 493/213; 493/254; 493/439; 493/248

[58] Field of Search ..... 493/248, 254, 439, 446, 493/455, 213, 380

[56] References Cited

U.S. PATENT DOCUMENTS

| | | | |
|---|---|---|---|
| 3,013,301 | 12/1961 | Lang . | |
| 3,482,491 | 12/1969 | Gustafson . | |
| 3,576,051 | 4/1971 | Click | 18/14 S |
| 3,577,301 | 5/1971 | Gustafson . | |
| 3,908,979 | 9/1975 | Cloud . | |
| 4,050,361 | 9/1977 | Traise | 493/439 |
| 4,277,302 | 7/1981 | Reid . | |
| 4,566,250 | 1/1986 | Matsumura . | |
| 4,603,536 | 8/1986 | de la Poype | 493/248 |
| 4,710,157 | 12/1987 | Posey | 493/248 |

FOREIGN PATENT DOCUMENTS

| | | |
|---|---|---|
| 0107474 | 5/1984 | European Pat. Off. . |
| 1191549 | 4/1965 | Fed. Rep. of Germany . |
| 1235343 | 5/1960 | France . |
| 2528801 | 12/1983 | France . |
| 1011428 | 12/1965 | United Kingdom . |
| 1504157 | 3/1978 | United Kingdom . |

*Primary Examiner*—Frederick R. Schmidt
*Assistant Examiner*—Jack W. Lavinder
*Attorney, Agent, or Firm*—Paul E. Schaffsma; Robert M. Barrett; Paul C. Flattery

[57] ABSTRACT

A shaping device for a web of flexible film having projecting ports comprising a shaping plate having a slit, for receiving the film, and an opening for receiving the port. An adjustable member is provided for limiting the length of the slit. A member is also provided for guiding the port into the opening.

8 Claims, 3 Drawing Sheets

CONFORMING DEVICE FOR A FLEXIBLE FILM PROVIDED WITH PROJECTING MOUTHPIECES

BACKGROUND OF THE INVENTION

The present invention relates to a shaping device for a flexible film, specifically, although not exclusively for making bags containing a perfusion liquid.

There are already known machines for manufacturing bags from a flexible film of plastic material. More specifically, there are known machines for manufacturing bags from a web of thermoplastic film. These machines include a series of stations at which the thermoplastic film is treated in succession. Generally, the film is unwound from a spool then perforated. Perpendicular to the perforations, ports or fitments are heat sealed by a welding head. The film is then shaped in a shaping device principally designed to fold the film back on itself in order to obtain an edge to edge sealing. The film that has been sealed edge to edge forms a tube that is then sealed in the transverse direction at regular intervals to form individual bags. Those individual bags are filled prior to manufacture of a second transverse seal which forms the bag.

The present invention relates particularly to the film shaping device, which is a station located after the positioning and sealing of the ports or fitments and prior to the sealing of the film edge to edge. French Pat. No. 2 528 801 describes a shaping device having a shaping plate extending in a direction transverse to a direction of the film. The device has a slit, preferably a U-shaped slit, with two arms joined together by a connecting portion and an opening adjacent to the slit. When the film equipped with ports or fitments has first been fed in a flat position and passes through the slit of the shaping device, it is folded back on itself and each port or fitment passes through the opening adjacent to the slit. At the exit of the shaping device, however, no special guiding is provided. A return is generally done by transverse rollers that project on each side of the film. When the ports or fitments are positioned along an edge of the shaped film, a risk exists that the flange of the port or fitment sealed to the film may press too strongly against the return roller and cause either a tearing of the film or damage to the seal between the flange and the film.

SUMMARY OF THE INVENTION

The present invention provides a shaping device for a flexible film equipped with projecting ports or fitments to ensure an even shaping of the film without any risk of damage.

To this end, the present invention provides a shaping device for a flexible film equipped with projecting ports or fitments, the shaping device includes a shaping plate extending in a direction transverse to the film, a slit with two arms joined together by a connecting portion, and an opening adjacent to the slit. The opening is positioned so that the ports or fitments will be positioned along one edge of the shaped film when the film exits the shaping device. A return roller in the shaping device having one end recessed relative to an edge of the folded film with the ports or fitments is located downstream from the shaping plate. This allows the ports or fitments to overhang relative to the return roller and no stress is exerted on the film nor on the flange of the ports or fitments.

In an embodiment of the invention, the shaping device has a lug means affixed to one end of the arms of the slit in the shaping plate in a direction transverse to the latter.

In that way, if the film does not present itself on an axis of the shaping device, one of its edge will rub against the lug means and causes the film to shift until it is suitably positioned on the axis of the device. According to a preferred embodiment of the invention, the lug means is movable, specifically it comprises a small plate placed flat against the shaping plate and held against it by movable means, preferably by bolts that run through the small plate and are engaged in apertures in the shaping plate. In that way, the shaping device can easily be adapted to films of different widths. According to another embodiment of the invention, the slit is surrounded along one edge, at least, by a reinforcing piece of sheet metal that extends in a direction perpendicular to the shaping plate. Preferably the slit is surrounded by a piece of sheet metal along one of its internal edges. In that way, the shaping plate may be manufactured from a thin piece of sheet metal and the reinforcing sheet metal acts both as a strengthening member for the shaping plate and as a guide for the film that passes through the shaping device.

In another embodiment of the invention, the shaping device has guiding means on at least one side of the opening adjacent to the shaping plate. These means are positioned upstream from the slit in the direction of movement of the film. The guiding means, in an embodiment includes, curved-in metal plates having one end affixed to the shaping plate. In that way, the guiding means act on the ports or fitments as a channel, so that the port or fitment suitably passes through the opening adjacent to the slit even when the film is not precisely in the axis of the shaping device.

Over characteristics and advantages of the present invention will be apparent upon a reading of the detailed description of the presently preferred embodiments and the attached drawings:

DETAILED DESCRIPTION OF THE PRESENTLY PREFERRED EMBODIMENT

Figure 4:
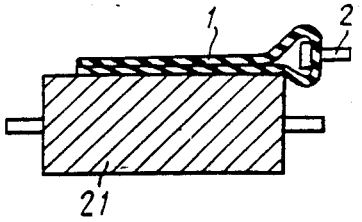
FIG. 4 is a side cross-sectional view of plane 4 in FIG. 1.

A shaping device constructed in accordance with the principles of the present invention is shown in FIGS. 1, 2, 3, and 4. The shaping device is designed to fold back on itself a flexible film 1 of thermoplastic material, equipped with ports or fitments 2 that project relative to the film 1. The shaping device includes a shaping plate 3 that extends in a direction transverse to a direction of film 1. The shaping plate 3 has an external portion 4 and an internal portion 5. The external portion 4 of the shaping plate 3 has a U-shaped internal edge 6, and the internal portion 5 of the shaping plate 3 has an external edge 7 slightly smaller than the internal edge 6. The internal and external portions of the shaping plate 3 are connected together by a cross piece 8 so that the internal edge 6 of plate portion 4 and the external edge 7 of internal plate portion 5 face each other and form between them a slit 9 having two parallel arms joined by a connection member. The shaping plate 3 further has an opening 10 adjacent to the slit 9. The opening 10 has a shape and a size suitable to allow the ports or fitments 2 to pass therethrough when the film 1 runs through the shaping device. The cross piece 8 extends beyond the external edges of the external plate portion 4 and is affixed to a frame of the machine (not shown). At its end opposite cross piece 8, the shaping plate 3 is also fixed to a cross piece 11 which is connected to the frame of the machine.

In an embodiment, illustrated in the figures, the shaping device has movable lug means which are formed by a small plate 12 affixed to one end of the arms of the slit 9 in a direction transverse to the slit. The small plate 12 is positioned flat against and below the shaping plate 3, the small plate 12 is fixed to the shaping plate 33 by movable means that include bolts 13 running through the small plate 12, engaged in apertures 14 of the shaping plate 3 and secured by screwnuts 15.

Figure 1:
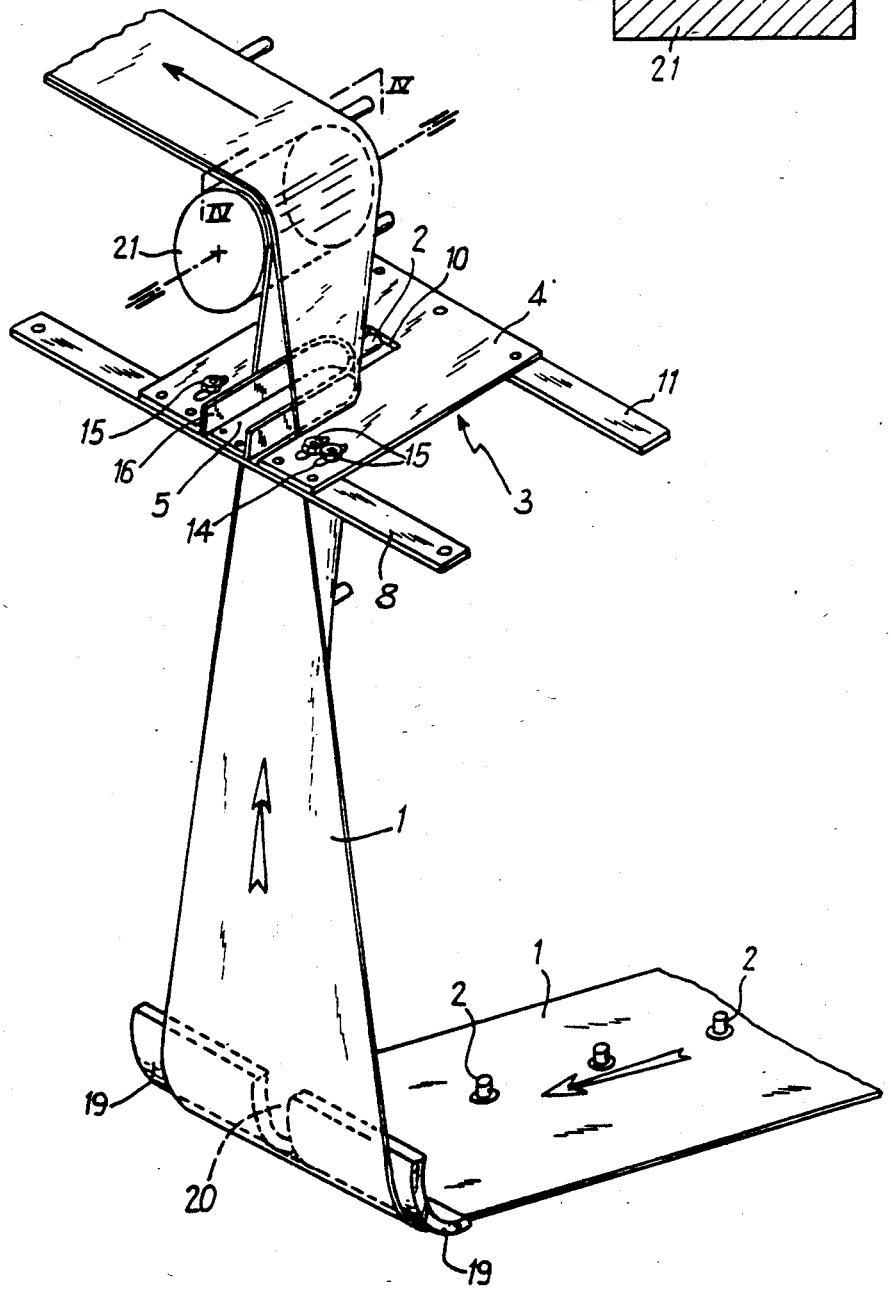
FIG. 1 is a front perspective view showing a front and top of a shaping device constructed in accordance with the principles of the present invention.
Figure 2:
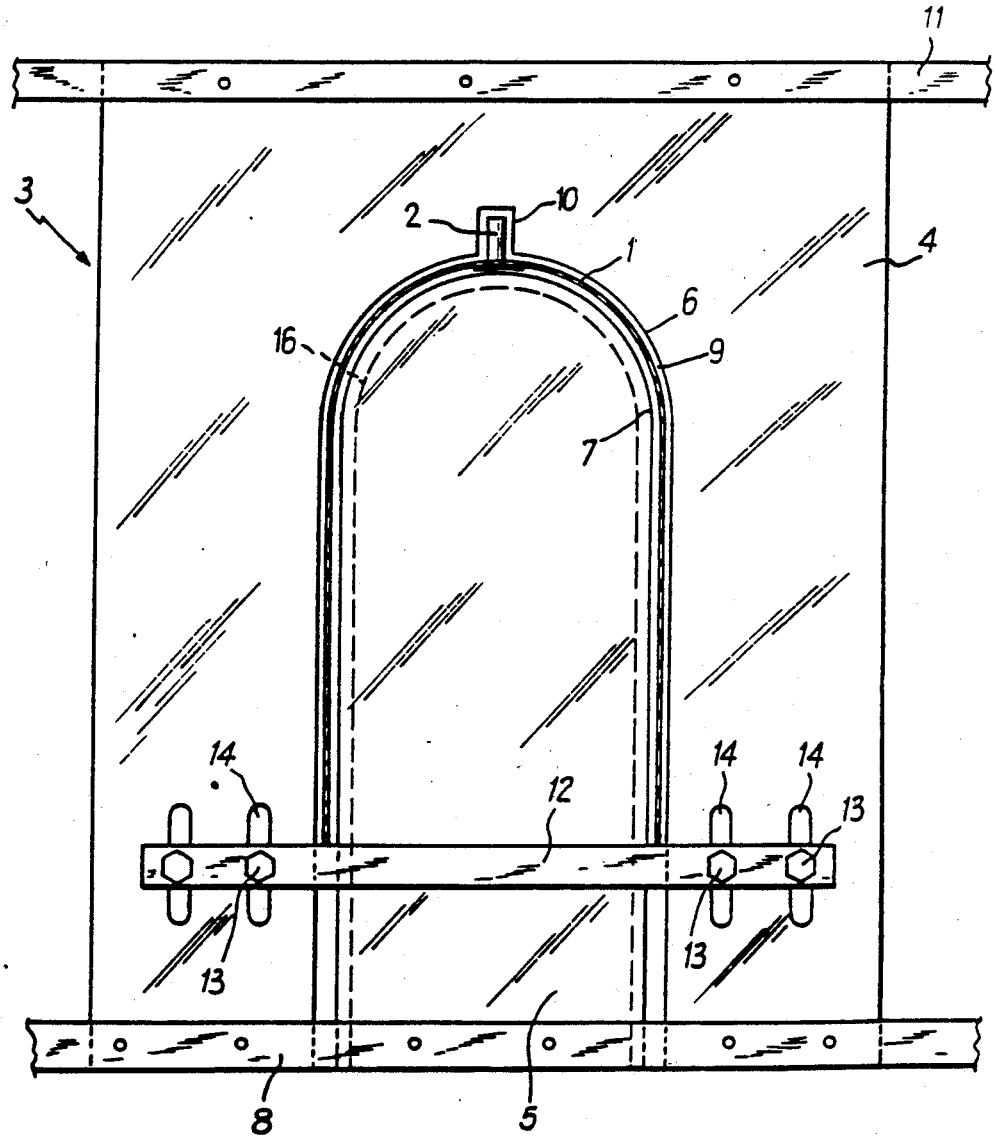
FIG. 2 is a bottom view of the shaping device according to the invention.

As shown in FIG. 1, the slit 9 preferably is surrounded on one edge at least and especially along its internal edge 7 with a reinforcing piece of sheet metal 16 that extends in a direction perpendicular to the shaping plate 3. In that way reinforcing plate 16 increases the rigidity of the internal portion 5 of the shaping plate 3 and at the same it ensures a guiding of the internal wall of film 1.

Figure 3:
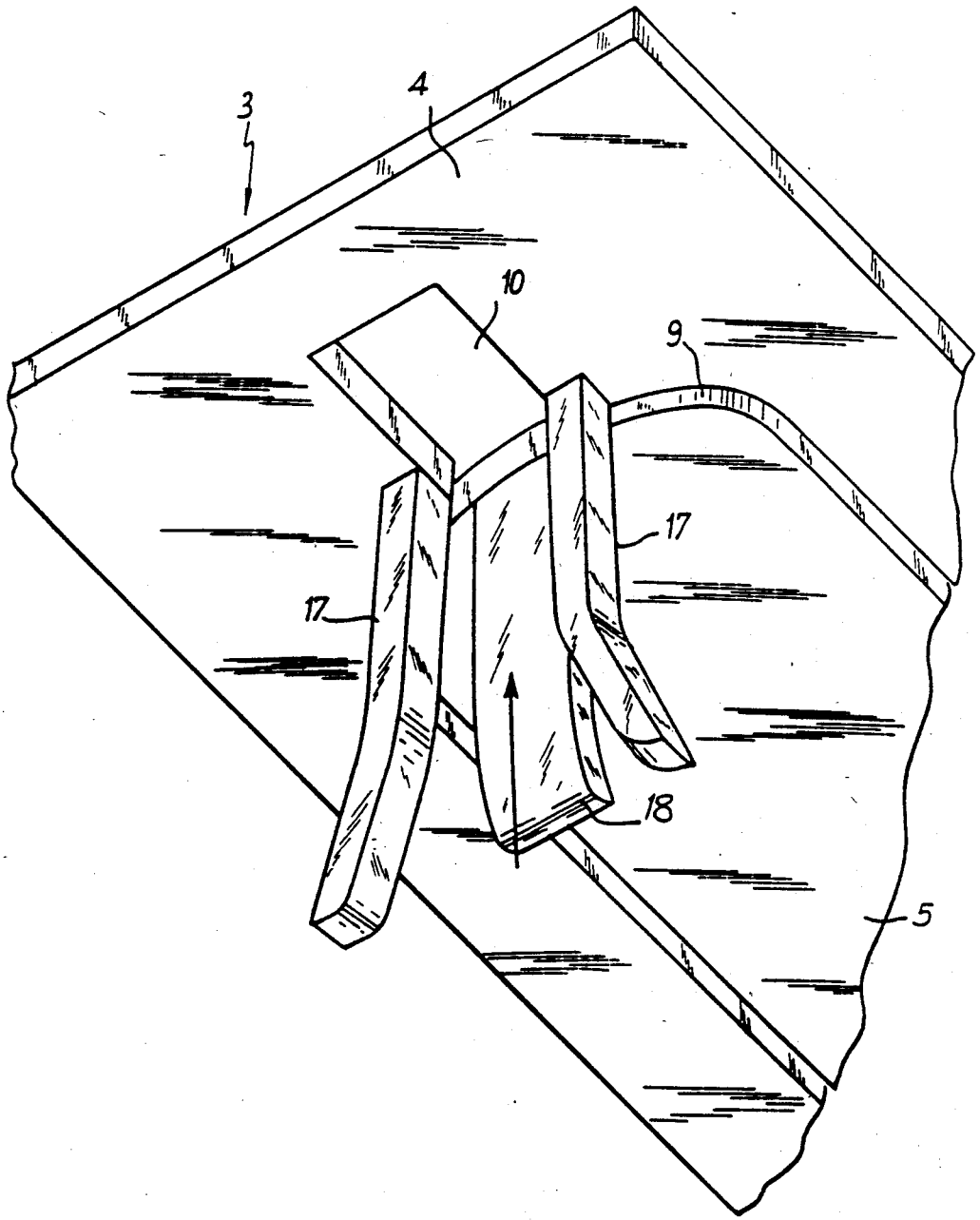
FIG. 3 is a partial bottom perspective view according to the invention that shows a guiding means for a port or fitment.

FIG. 3 is a bottom perspective view of a portion of the shaping plate 3. This figure essentially shows the guiding means for the ports or fitments 2 that extend over three sides of opening 10 adjacent to slit 9. The guiding means has curved-in metal plates 17 affixed at one of their ends, by welding for example, to the external portion 4 of the shaping plate 3 on each side of opening 10, and a curved-in metal plate 18 affixed by one of its ends to the edge of the internal portion 5 of the shaping plate that faces opening 6. The curved-in metal plates 17 and 18 extend below the shaping plate 3 and their curved-in part diverges downwardly from each other. The guiding means is positioned upstream from slit 9 in the moving direction of the film 1.

Upstream from the shaping device, there are advantageously provided curved-in return plates 19 separated by a spacing 20 that permit the ports or fitments 2 to pass. Downstream from the shaping plate 3, there is advantageously provided a return roller 21 having an end recessed relative to a folded edge of film 1. This allows the ports or fitments 2 to overhang relative to the return roller 21, as shown in FIG. 4, so that no stress is exerted on the ports or fitments 2.

It should be understood that the invention is subject to variations in constructions which will be apparent to those skilled in the art. Specifically, the U-shaped slit 9 may be replaced with a V-shaped slit. Also, even though in the embodiment illustrated opening 10 is provided on the side of the member connected the two arms of slit 9, the opening 10 may be positioned adjacent to an arm when the port or fitment 2 is to be located finished bag, on a face of the folded film 1 rather than on the fold of the film 1. In the case of a port or fitment 2 turned toward the return roller 21, there is advantageously provided in the roller a groove of corresponding shape that permits the ports or fitments 2 to pass over the return roller 21 without any deformation of the film 1.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

We claim:

1. A shaping device for a web of flexible film having projecting ports, the shaping device including a shaping plate which extends in a direction transverse to the film and includes a slit having two arms joined together by a connecting member, and an opening adjacent to the slit, the opening being located so that the ports will be positioned along one edge of the shaped film at the exit of the shaping device, the shaping device including a return roller having an end that is recessed relative to an edge of the folded film having the ports that are positioned downstream from the shaping plate; the shaping device further including movable lug means affixed to the shaping plate, in a direction transverse to the plate, the lug means comprising a small plate positioned flat against the shaping plate and affixed to the plate by movable means.

2. A shaping device according to claim 1 wherein the movable means includes bolts running through the small plate and engaged in apertures of the shaping plate.

3. A shaping device according to claim 1 wherein the slit is surrounded on at least one edge by reinforcing means that extend perpendicular to the shaping plate.

4. A shaping device according to claim 3 wherein the slit is surrounded by the reinforcing means along an internal edge of the slit.

5. A shaping device according to claim 1 wherein the shaping device further includes guiding means located on the shaping plate, on one side at least of the opening adjacent to the slit, upstream from the latter, in the direction of displacement of the film.

6. A shaping device according to claim 5 wherein the guiding means comprise curved-in metal plates having one of their ends affixed to the shaping plate.

7. A shaping device according to claim 1 including guiding means coupled to the shaping plate on one side of the opening adjacent to the slit, upstream from the opening in a direction of displacement of the film.

8. A shaping device according to claim 7 wherein the guiding means includes curved-in metal plates having one of their ends affixed to the shaping plate.

* * * * *